United States Patent [19]

Deaton et al.

[11] Patent Number: 4,798,247

[45] Date of Patent: Jan. 17, 1989

[54] SOLENOID OPERATED SAFETY VALVE AND SUBMERSIBLE PUMP SYSTEM

[75] Inventors: Thomas M. Deaton, Dallas; Donald H. Perkins, Carrollton, both of Tex.

[73] Assignee: Otis Engineering Corporation, Dallas, Tex.

[21] Appl. No.: 73,762

[22] Filed: Jul. 15, 1987

[51] Int. Cl.[4] ..... E21B 34/06

[52] U.S. Cl. ..... 166/373; 166/66.4; 166/332; 251/129.2

[58] Field of Search ..... 166/65.1, 66.4, 66.5, 166/316, 332, 373; 251/129.05, 129.20, 129.21

[56] References Cited

U.S. PATENT DOCUMENTS

| | | | |
|---|---|---|---|
| 3,032,111 | 8/1960 | Corley, Jr. et al. | 166/65 |
| 3,665,955 | 5/1972 | Connor, Sr. | 166/65 |
| 3,739,845 | 6/1973 | Berry et al. | 166/65 |
| 3,750,700 | 8/1973 | Ecuer | 137/498 |
| 3,861,464 | 1/1975 | Boyadjieff et al. | 166/224 |
| 3,865,142 | 2/1975 | Begun et al. | 137/635 |
| 4,002,202 | 1/1977 | Huebsch | 166/65 |
| 4,160,484 | 7/1979 | Watkins | 166/317 |
| 4,161,215 | 7/1979 | Bourne, Jr. et al. | 166/65 |
| 4,321,946 | 3/1982 | Paulos et al. | 166/65 |
| 4,337,829 | 7/1982 | Banzoli et al. | 166/366 |
| 4,354,554 | 10/1982 | Calhoun et al. | 166/321 |
| 4,425,965 | 1/1984 | Bayh, III et al. | 166/106 |
| 4,440,221 | 4/1984 | Taylor et al. | 166/106 |
| 4,529,035 | 7/1985 | Bahy, III | 166/106 |
| 4,566,534 | 1/1986 | Going, III | 166/65 |
| 4,617,960 | 10/1986 | Moore | 137/554 |
| 4,649,993 | 3/1987 | Going, III | 166/65 |

*Primary Examiner*—Stephen J. Novosad
*Assistant Examiner*—Terry Lee Melius
*Attorney, Agent, or Firm*—Johnson & Swanson

[57] ABSTRACT

A power supply and control arrangement for a submersible pump and solenoid operated safety valve system. A surface control unit is connected to a downhole control unit by a three conductor cable. A single phase 400 Hz signal from the surface unit is rectified downhole and operates the solenoid to open the safety valve but is too high a frequency to affect the pump motor. A downhole detector senses full open condition of the safety valve and sends a signal to the surface where it is received by a monitor. The monitor interrupts the 400 Hz signal and applies a three phase 60 Hz signal to all three conductors of the cable to operate the pump motor and be rectified downhole to hold the solenoid and safety valve open. Loss of the valve open signal by the monitor interrupts the 60 Hz signal and disables the system until it is reset.

33 Claims, 4 Drawing Sheets

FIG. 3
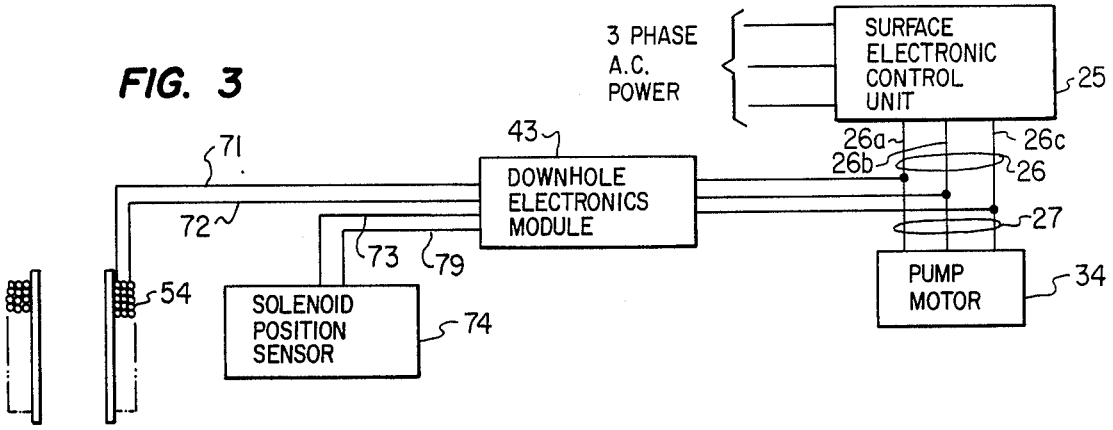
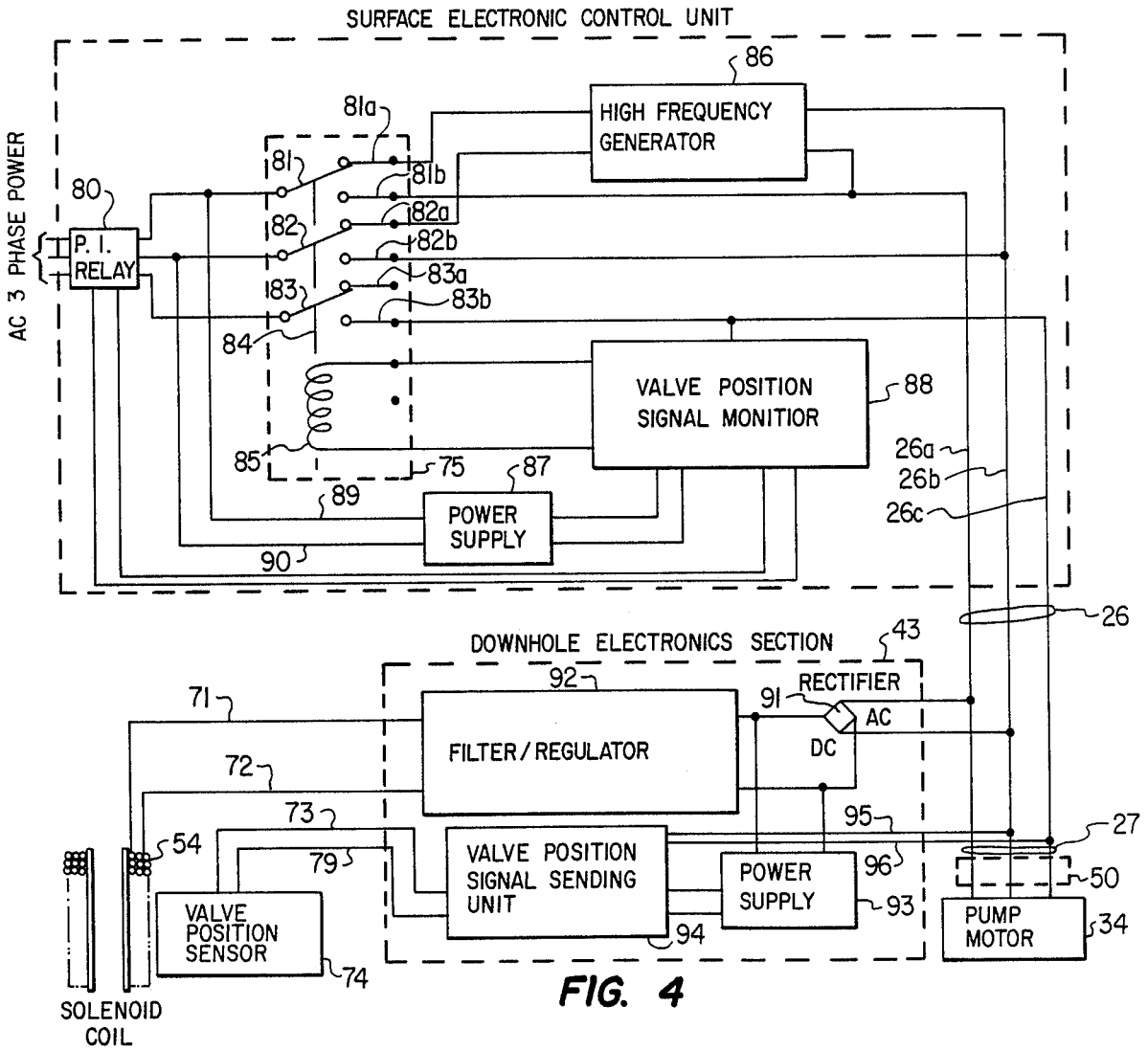
FIG. 4

SOLENOID OPERATED SAFETY VALVE AND SUBMERSIBLE PUMP SYSTEM

BACKGROUND OF THE INVENTION

1. Field of the Invention

The invention relates to downhole systems for controlling the flow of fluids from petroleum production wells and, more particularly, to a power supply and control arrangement for a submersible pump and solenoid operated safety valve system.

2. History of the Prior Art

Oil and gas wells, and in particular those located offshore, are frequently subject to wellhead damage which may be produced by violent storms, collisions with ships and numerous other disasterous occurrences. Damage to the wellhead may result in the leakage of hydrocarbons into the atmosphere producing the possibility of both the spillage of the petroleum products into the environment as well as an explosion and fire resulting therefrom. In addition to off-shore production wells, another environment in which damage to a wellhead may have disasterous effects is that of producing wells located in urban areas. Moreover, in such urban production wells it is generally a specific legal requirement that there be some downhole means of terminating the flow of petroleum products from the well in the event of damage to the wellhead. In such instances, the safety valve must be responsive to a dramatic increase in flow rate from the well so as to close down and terminate production flow from the well. For these reasons, sub-surface safety valves located downhole within the borehole have long been included as an integral part of the operating equipment of a petroleum production well.

Various types of petroleum production flow safety valve systems have been provided in the prior art. Each system includes a valve means for controlling the flow of petroleum up the tubing from a point down in the borehole from the wellhead. Safety valve systems include sensing means which are responsive to wellhead damage, a dramatic increase in production flow or some other emergency condition requiring that the flow from the well be terminated by the valve.

One type of operating mechanism to actuate a safety valve within the well is shown in U.S. Pat. No. 3,861,464 to Boyadjieff et al which includes a mechanical actuation means comprising an elongate cable extending from the wellhead down to the safety valve whereby movement of the cable effects opening and closing of the valve. Such mechanical actuation systems are severely limited with respect to the depth to which such systems are operable and also include the inherent disadvantages of potential stickage, cable stretching and other mechanical failures affecting operation of the valve.

The most common method for controlling downhole petroleum flow safety valves is that of a hydraulic control line extending from a pressure reservoir at the wellhead down the borehole to the safety valve. Generally, safety valves are spring biased into a closed condition and opening the valve to allow production flow requires the application of a hydraulic pressure to overcome the spring bias and hold the valve in an open condition. In the event of a failure of the hydraulic system or damage to the wellhead or to the hydraulic line, release of the hydraulic pressure allows the spring to automatically close the safety valve thereby providing a safe operation. One such system is shown in U.S. Pat. No. 4,160,484 to Watkins. A related type of hydraulic control system for safety valves is one in which the flow of the production fluid produces a pressure which is balanced against a control hydraulic pressure from the wellhead. In the event that the flow produced pressure becomes much greater, for example due to runaway production flow through the valve, this flow produced pressure overcomes the control pressure and closes the safety valve in response to the emergency flow condition. Such a system is shown in U.S. Pat. No. 3,750,700 to Ecuer.

All hydraulic pressure controlled safety valve systems have certain inherent disadvantages. One limitation is the depth to which the system is operable. That is, the length of the line through which the hydraulic fluid is operable determine the final downhole operating pressure of the fluid. In very deep wells this produces an extremely high operating pressure at the safety valve. In some cases the downhole hydraulic pressure becomes so great at a certain depth that it cannot be overcome by spring biased type systems. This in effect renders such a system, which would otherwise be perfectly effective in shallower wells, less useful in very deep production situations. In addition, the hydraulic pressure in closed static hydraulic pressure circuits often become extremely high which produces a very dangerous condition both within the well and for personnel working around and with the hydraulic system at the surface.

Some of the disadvantages of hydraulic and mechanically actuated safety valve systems are overcome by the use of an electrical solenoid to operate the safety valve in a downhole production environment. Numerous such systems have been proposed, for example, U.S. Pat. No. 4,002,202 to Huebsch et al, U.S. Pat. No. 4,161,215 to Bourne, Jr. et al, and U.S. Pat. No. 4,566,534 Going III. Such systems provide a solenoid actuated operating mechanism for the safety valve which is responsive to a DC electric current supplied from surface equipment. Such solenoids generally require a fairly high level surge of initial operating current to cause the solenoid to change states and then a smaller level of current to hold the solenoid in its new operating condition. These large actuating current surges require heavy electrical conductors in order to carry such current downhole for any substantial distance and still maintain a voltage level sufficient to operate the solenoid.

In hydrocarbon producing formations where there is sufficient reservoir pressure to cause formation fluids to flow spontaneously to the well surface, only flow control valves are required to regulate the flow of fluids up the tubing. However, in well production environments in which the natural reservoir pressure is lower than that required to produce a desired flow rate of fluids from the well, it is frequently necessary to use an electrically powered submersible pump down in the well in order to achieve the desired hydrocarbon flow rate. Such submersible pump actuated systems also necessitate the use of a subsurface safety valve for the reasons discussed above. In most production systems which include electrically operable submersible pumps it is conventional to employ a hydraulically controlled safety valve such as is shown in U.S. Pat. No. 4,529,035 to Bayh and U.S. Pat. No. 4,354,554 to Calhoun et al. Moreover, in U.S. Pat. No. 4,425,965 to Bayh et al the hydraulic output of the pump itself is used to provide actuating pressure for the hydraulically actuated safety valve.

Electrically operated submersible pumps require an electrical transmission line for AC power, generally in a three phase configuration, from the wellhead downhole to the pump in order to drive the electric motor powering the pump. Conventional submersible pump production systems have also required a hydraulic transmission line extending from the wellhead to a location near the submersible pump in order to provide an actuation and control circuit for the hydraulically actuated safety valve used with the pump. Such conventional production equipment configurations thus require redundant circuits, one electrical and one hydraulic. Such circuits also necessitate two mutually independent actuation and control systems which are not interfaceable directly with one another.

There are certain disadvantages inherent in the combination of an electrically operated submersible pump and an electrically operated safety valve. One disadvantage is that while AC power is required to actuate the pump, DC power is usually necessary to operate the solenoid actuating the safety valve thus requiring a large expenditure on redundant electrical cable, one for AC and one for DC.

The system of the present invention overcomes many of the inherent disadvantages of the prior art solenoid operated safety valves systems as well as enables the practical combination of a submersible pump and an electrical solenoid actuated safety valve into a single system.

SUMMARY OF THE INVENTION

The system of the present invention includes supplying power and control signals to a submersible pump and a solenoid operated safety valve in a petroleum production well completion within a borehole. A surface control unit selectively supplies electric power at a pair of different operating frequencies. The lower frequency power is capable of driving a motor for the pump and the higher frequency power is not. A downhole control unit is responsive to the higher frequency power for actuating a solenoid to open the safety valve and responsive to the open condition of the safety valve to produce a signal. A cable interconnecting the surface control unit and the downhole control unit for conducting power at both frequencies downhole and providing signalling uphole indicative of the open or closed condition of the safety valve. The surface control unit first connects the higher frequency power to the cable and then, in response to a valve open condition signal, connects the lower frequency power to the cable to drive the motor for the pump and to hold the solenoid and safety valve in an open condition.

Another aspect of the invention includes a downhole control unit for use in a control and power supply system for controlling the operation of a submersible pump and solenoid operated safety valve system of the type including a surface control unit for supplying AC electrical power to a cable extending downhole to the motor driving the pump and to the solenoid operating the safety valve. The downhole control unit is connected to the cable from the surface unit and includes means for producing current to actuate the solenoid and control the opening of the safety valve circuitry and effect the connection of AC current to the motor to drive the pump when the safety valve is open.

In still a further aspect the invention, there is included a submersible pump and solenoid operated safety valve system for use in a borehole. A submersible pump is driven by an electric motor and connected to the end of a tubing string extending from the surface down into the borehole. A solenoid operated safety valve is connected between the output of the submersible pump and the tubing string to interrupt the flow of well fluids up the tubing in response to the interruption of current to the solenoid holding the safety valve in an open condition. A downhole control unit is mounted near the end of the tubing string and connected to a surface control unit and to the motor of the pump by means of an electrical cable. AC electrical power is supplied from the surface unit down the conductors of the cable. The downhole control unit rectifies the AC power to provide DC electric current for operating the solenoid to open the safety valve. A sensor detects when the safety valve is in an open condition and controls the connection of AC power to the motor of the pump.

BRIEF DESCRIPTION OF THE DRAWING

For an understanding of the present invention and for further objects and advantages thereof, reference can now be had to the following description taken in conjunction with the accompanying drawings in which:

FIG. 3 is an overall block diagram of the system of the present invention;

FIG. 4 is an more detailed block diagram of the system of the present invention.

DESCRIPTION OF THE PREFERRED EMBODIMENT

Figure 1:
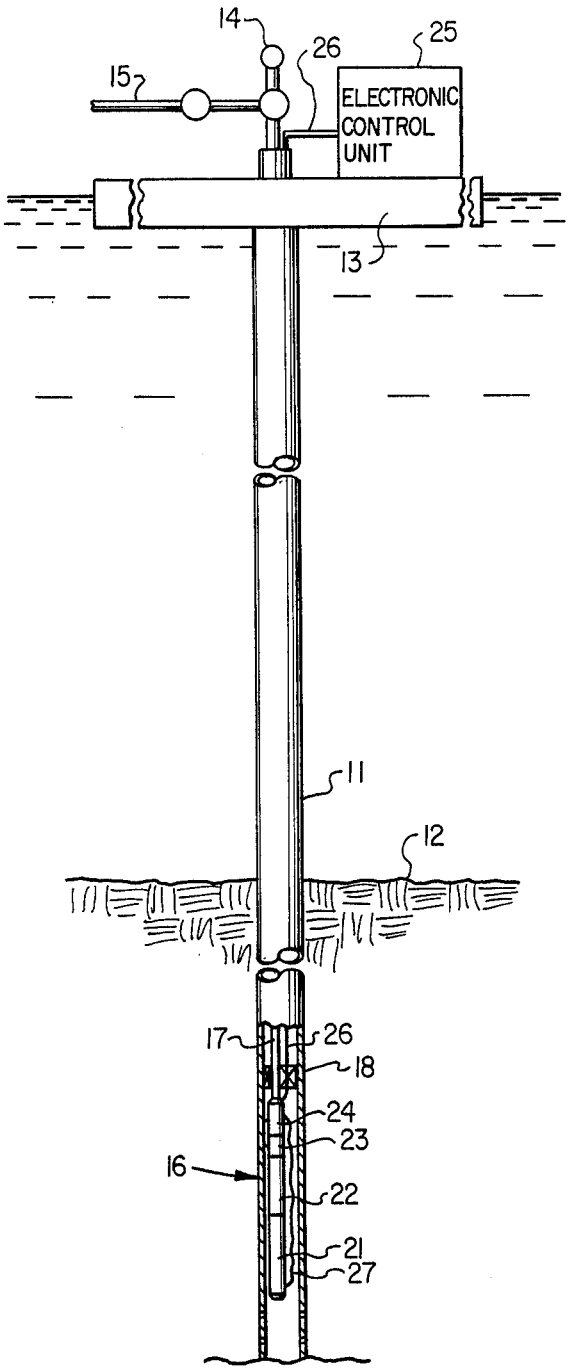
FIG. 1 is a schematic drawing of an off-shore well completion including a submersible pump and a solenoid operated safety valve system constructed in accordance with the teachings of the present invention.

Referring first to FIG. 1 there is shown a schematic illustration of an off-shore well completion incorporating the system of the present invention. A casing 11 extends from the entrance of the bore hole in the sea bed 12 to an operating platform 13 supported at the sea surface in any one of a plurality of different manners. The platform mounts the typical Christmas tree production flow control configuration 14 having an output line 15 leading to storage facilities (not shown) for production flow from the well.

Down in the well there is located a submersible pump and safety valve assembly 16 suspended from the lower end of well tubing 17 and located beneath a well packer 18. The submersible pump and safety valve assembly 16 includes a motor and seal section 21, a pump section 22, a solenoid operated safety valve module 23 and a downhole control electronics section 24. The downhole electronics section 24 is connected to a surface electronic section 25 located on the platform 13 by means of a power cable 26. Power is supplied from the downhole control electronic section 24 to the pump by means of cable 27.

Figure 2:
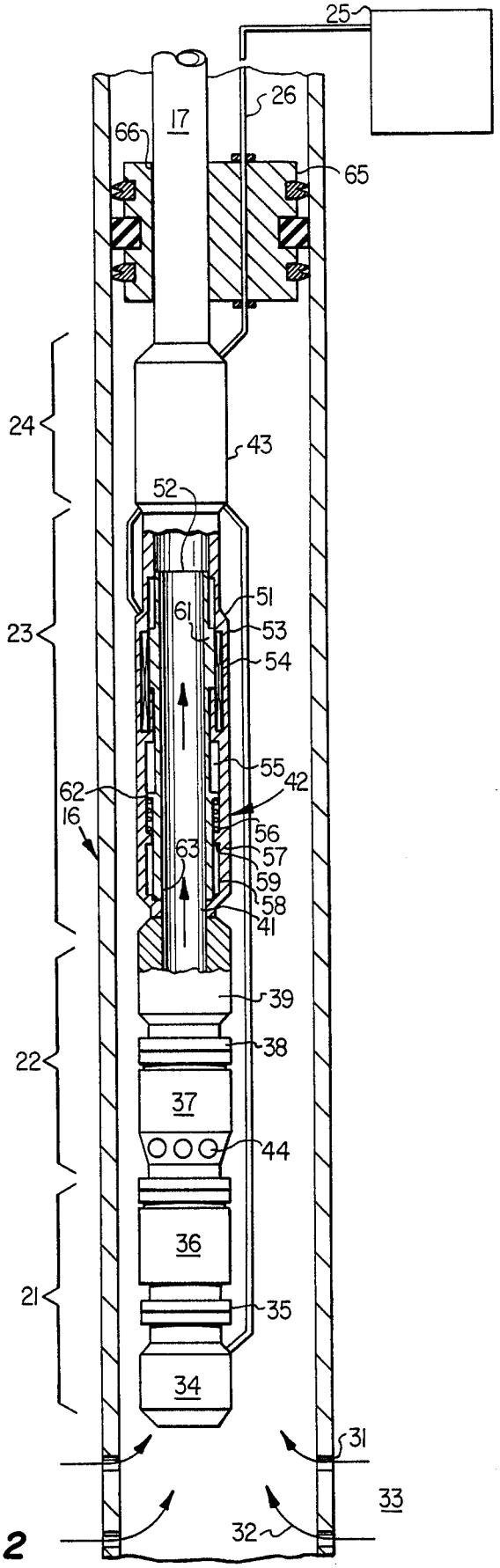
FIG. 2 is a cross-section schematic drawing of the submersible pump and solenoid operated safety valve system of the present invention.

Referring next to FIG. 2 there is shown a schematic cross-sectional view of the lower end of the casing 11 shown in FIG. 1. The walls of the casing 11 has perforations 31 to allow the influx of borehole fluids 32 from within the formation 33 to the interior of the casing 11. The fluids are then pumped up the tubing 17 of the well completion to the surface as production flow of the well. The pumping unit assembly consists of the motor and seal section 21 at the lower end of the sub 16 which is axially connected to the pump section 22. The pump motor preferably comprises a three phase electric motor 34 having an axially extending rotatable shaft which passes through a flange coupling 35 and into rotational engagement with a seal section 36. The rotational output of the seal 36 is in actual alignment and rotational connection with the pump input section 37 which is, in turn, axially connected by means of a flange coupling 38 to the pump output section 39. The fluid discharge outlet of the pump 41 is coupled into a generally cylindrical electric solenoid operated subsurface safety valve 42. The fluid output of the safety valve 42 is connected through an axial opening in a downhole electronic control unit module 43. The output fluid from the pump section 22, after having passed through the safety valve 42 and electronic module 43, is coupled to the well production tubing 17 which carries it up the borehole to the Christmas tree 14 at the surface and, thus, to the output line 15.

The fluid collected and coupled into the interior of the casing 11 through the perforations 31 is drawn into the pump intake ports 44 by the lower pressure at the pump input section 37. The fluid flow from the outlet of the pump 41 passes into the solenoid operated sub-surface safety valve 42. The safety valve 42 consists of an outer cylindrical housing 51 within which is slidably mounted a cylindrical insert 52 mounted for axial movement within the outer housing 51. The outer cylindrical housing 51 includes an inner upper cylindrical recess 53 within which is mounted a multiply wound solenoid coil 54. An inner central recess within the outer housing 51 is shown at 55 and has positioned in the lower portion thereof a valve closing helical spring 56. An inner lower recess in the outer housing 51 is shown at 57 and receives a valve flap member 58 which is pivotally mounted by a hinge 59 to the upper inside portion of the recess 57 and spring biased toward closing the longitudinal passageway through the valve 42. The slidably movable cylindrical insert 52 includes an upper radially extending stepped magnetic region 61 in general alignment with the solenoid coil 54. A narrow centrally located radially extending stepped region 62 engages the upper portion of the helical spring 56.

When the solenoid actuated safety valve is actuated to the open position, the electric current flowing through the solenoid coil 54 pulls the radially extending stepped region 61 downwardly into the position shown in FIG. 2. This causes the narrow radially extending region 62 to compress the helical spring 56 and move the lower edge 63 of the cylindrical insert 52 down past the valve closure flap member 58 moving it about its pivot point 59 and pressing it into its recess 57 to hold the valve 42 in the open position. Interrupting the flow of electrical current through the solenoid coil 54 allows the compressed spring 56 to expand upwardly to cause the radially extending stepped region 62 and the cylindrical insert 52 to move upwardly. This allows the spring biased valve closure flap member 58 to come out of its recess 57 and pivot across the longitudinal passageway within the valve 42 blocking the flow of well fluids from the discharge outlet of pump 41 up the tubing 17. The electrical current to the pump is interrupted and the pump is shut off prior to the closure of the valve 42 so that blocking the flow from the pump outlet 41 does not cause damage to the pump.

The assembly 16 is enclosed within the lower portion of the casing 11 by means of the well packer 65 which includes a longitudinal bore for closely receiving the outer walls of the tubing 17 and which also includes a second longitudinal bore 67 for closely receiving the power and control cable 26. The well packer 65 seals to the inner walls of the casing 11 in conventional fashion. Electrical power and control signals from the surface power supply and electronic control unit 25 are conducted down the cable 26 through the well packer 65 into the downhole electronic control unit 43. The downhole electronic control unit 43 is coupled to the solenoid coil 54 by internal conductors (not shown) and to the motor 34 of the pump by means of electrical cable 27.

Referring now to FIG. 3 there is shown an overall schematic block diagram of the electrical power supply and control circuitry of the system of the present invention. A source of three phase AC power is connected into the surface electronic control unit 25. The output power and control signals between the surface unit 25 and the downhole equipment are coupled by means of a cable 26 comprising three conductors 26*a*, 26*b* and 26*c* which conduct the three phase AC power to the pump motor 34 along with the other signals as described below. The three conductors 26*a*–26*c* from the surface electronic control unit 25 are first connected to the downhole electronic module 43 and from there on to the pump motor 34 via cable 27. The output from the module 43 is connected by means of a pair of conductors 71 and 72 to the conductors of the solenoid coil 54 controlling the solenoid actuated safety valve of the present system. In addition, the electronic module 43 is also coupled through conductor 73 and 79 to a valve position sensor 74 which monitors the position of the safety valve and provides an indication to the downhole electronic module 43 as to its position. That is, from the output of the valve position sensor 74 on lines 73 and 79 a position indication is provided to the downhole electronic module 43, which sends a signal up hole via the cable 26 indicative of the state of closure the solenoid actuated safety valve. Thus, it can be seen that the same three conductors of the electrical cable 26 from the surface electronic control unit 25 are used to power the pump motor 34, to provide current through the downhole electronic module and control the solenoid actuated safety valve, and also to provide an indication up hole as to the position of the safety valve itself as detected by the valve position sensor 74. By way of example only, it should be understood that many different types of valve position sensors are available. One exemplary type of such sensor is shown in U.S. Pat. No. 4,321,946 to Paulos et al issued Mar. 30, 1982. It should be understood that many other different techniques may be used to detect and signal the position of the solenoid operated safety valve in addition to the one shown in the Paulos et al Patent.

Referring next to FIG. 4, there is shown a more detailed schematic block diagram of the electrically operated pump and safety valve system constructed in accordance in the teaching of the present invention. There it is shown that three phase 60 Hz AC power is connected into the surface electronic control unit 25 through a power interrupt relay 80 which, upon actuation, disconnects all AC power to the unit 25 until it is reset. The output of relay 80 is coupled to a switching unit such as a triple poledouble throw relay 75 having three contacts 81, 82 and 83 connected, respectively, to each of the leads of the input three phase AC power. The contacts 81–83 are connected to a common actuating mechanism 84, the position of which is controlled by the state of a relay solenoid coil 85. When the coil 85 is unenergized, the contacts 81, 82 and 83 are in electrical contact with a first set of contacts 81*a*, 82*a*, and 83*a* and when the relay coil is in the energized state the actuating mechanism 84 is moved to its other position so that the contacts 81, 82 and 83 come into electrical engagement with a second set of contacts 81*b*, 82*b* and 83*b*. The output of contacts 81*a* and 82*a* are connected to the power input of a high frequency generator 86, which produces, for example, a 400 Hz output signal which is connected to two conductors 26*a* and 26*b* of the three conductor cable 26 leading downhole. The third contact 83*a* is open. The three lower contacts 81*b*, 82*b* and 83*b* are connected respectively to all three of the conductors 26*a*, 26*b* and 26*c* of the downhole cable 26.

One phase of the three phase input power from the interrupt relay 80 is connected to a power supply 87 the regulated DC output voltage of which is connected to a valve position signal monitor 88. The monitor 88 is connected to the two conductors 26*b* and 26*c* of the cable 26 to detect signals thereon from the downhole unit 43 and, in response thereto, provides a current to activate the coil 85 of the relay 75 when the downhole solenoid operated safety valve is in a full open condition allowing a flow of well fluids from the pump outlet 41 up the tubing 17.

The output of the generator 86 produces high frequency single phase AC power, e.g., 400 Hz, onto the conductors 26*a* and 26*b* which are connected to the downhole electronic section 43 and the input side of a bridge rectifier circuit 91. The output of the bridge 91 is connected to the input of a filter/regulator circuit 92 which filters and regulates the rectified high frequency signal to provide a regulated DC output current on lines 71 and 72 into the solenoid coil 54. Thus, the high frequency AC signal sent downhole on conductors 26*a* and 26*b* from generator 86 is rectified, filtered and regulated in the downhole unit 42 to supply an actuation and holding current to operate the solenoid coil 54 of the safety valve. By way of example only, the solenoid coil 54 may require a 30 volt, 10 amp signal to initially change the state of the solenoid and then a much smaller signal, typically 6 volts at 2 amps, as a holding current. The high frequency voltage on conductors 26*a* and 26*b* does not affect the pump motor 34 because of the high impedence of the windings of the motor to such frequencies. In the event the pump motor 34 is affected by the particular high frequency selected for use, an optional low pass filter 50 may be included in the electrical lines between the rectifier 91 and the windings of the motor 34. The pass band of the optional filter 50 is selected to reject the high frequency voltage while allowing passage of the low frequency voltage (e.g., 60 Hz) to operate the pump motor 34.

The DC current from the bridge rectifier 91 is also connected to a power supply 93 which supplies current to a valve position signal sending unit 94. Unit 94 receives signals from the valve position sensor 74 by means of the conductors 73 and 79. The position of the valve closure flapper member 58 can be detected by sensor 74, e.g. a Hall effect device, and produce an output signal on conductors 73 and 79 when the valve is in full open condition. A signal on conductors 73 and 79 to the valve position signal sending unit 94 causes it to produce an output signal on conductors 95 and 96 which are connected to conductors 26*b* and 26*c* of the downhole cable 26, thus, to the valve position signal monitor 88 within the surface electronic unit 25. The valve full open output signal could comprise a steady state DC voltage signal or a signal of a distinct frequency, such as 1 KHz readily detectable by the surface electronic unit 25. Alternatively, the valve position signal sending unit 94 could produce signals in a pulsed format such as a first distinct pulse signal upon the valve assuming full open configuration and a second distinct pulse signal upon any change from that configuration, both of which pulse signals would be recognized by the surface unit 25. When the valve position signal monitor 88 is provided with a signal on conductors 26*b* and 26*c* indicating that the downhole solenoid operated safety valve is in the full open condition, current is supplied to the coil 85 of the relay 75 causing the three phase 60 Hz AC power to be applied directly to each of the conductors 26*a*, 26*b*, 26*c* of the downhole cable 26. Three phase, 60 Hz AC power drives the pump motor 34 to supply a flow of hydrocarbons from within the well through the safety valve 42 and up tubing 17 to the surface.

When the relay 75 is operated to connect the three phase 60 Hz AC to the cable 26, single phase power is simultaneously disconnected from the high frequency generator 86 which interrupts the 400 Hz signal on conductors 26*a* and 26*b*. However, the single phase 60 Hz signal on those two conductors 26*a* and 26*b* by which it is replaced is also rectified by the bridge 91, passed through the filter/regulator 92 and coupled to the solenoid coil 54 via lines 71 and 72. The filter/regulator 92 serves to regulate the current supplied to the solenoid coil 54, for example, to approximately 2 amps at about 6 volts, a typical holding current for such solenoids.

If the valve position sensor 74 detects that the valve 42 has started to change from full open condition, a change in the signal on conductors 73 and 79 causes the valve position signal sending unit 94 to change or interrupt the signal on lines 95 and 96. An interruption or distinct change in the valve open signal on conductors 26*b* and 26*c* is detected by valve position signal monitor 88 in the surface unit 25 which deenergizes the relay coil 85 and disconnects three phase AC power from cable 26 to stop the pump motor 34 before the safety valve 42 closes and causes pump damage. When the valve position signal monitor 88 interrupts current to the relay coil 85, it also sends a signal on conductors 89 and 90 to actuate the power interrupt relay 80 which prevents voltage from being reconnected to the high frequency generator 86 and reclosing of valve solenoid 54 until the interrupt relay 80 is reset.

Figure 5:
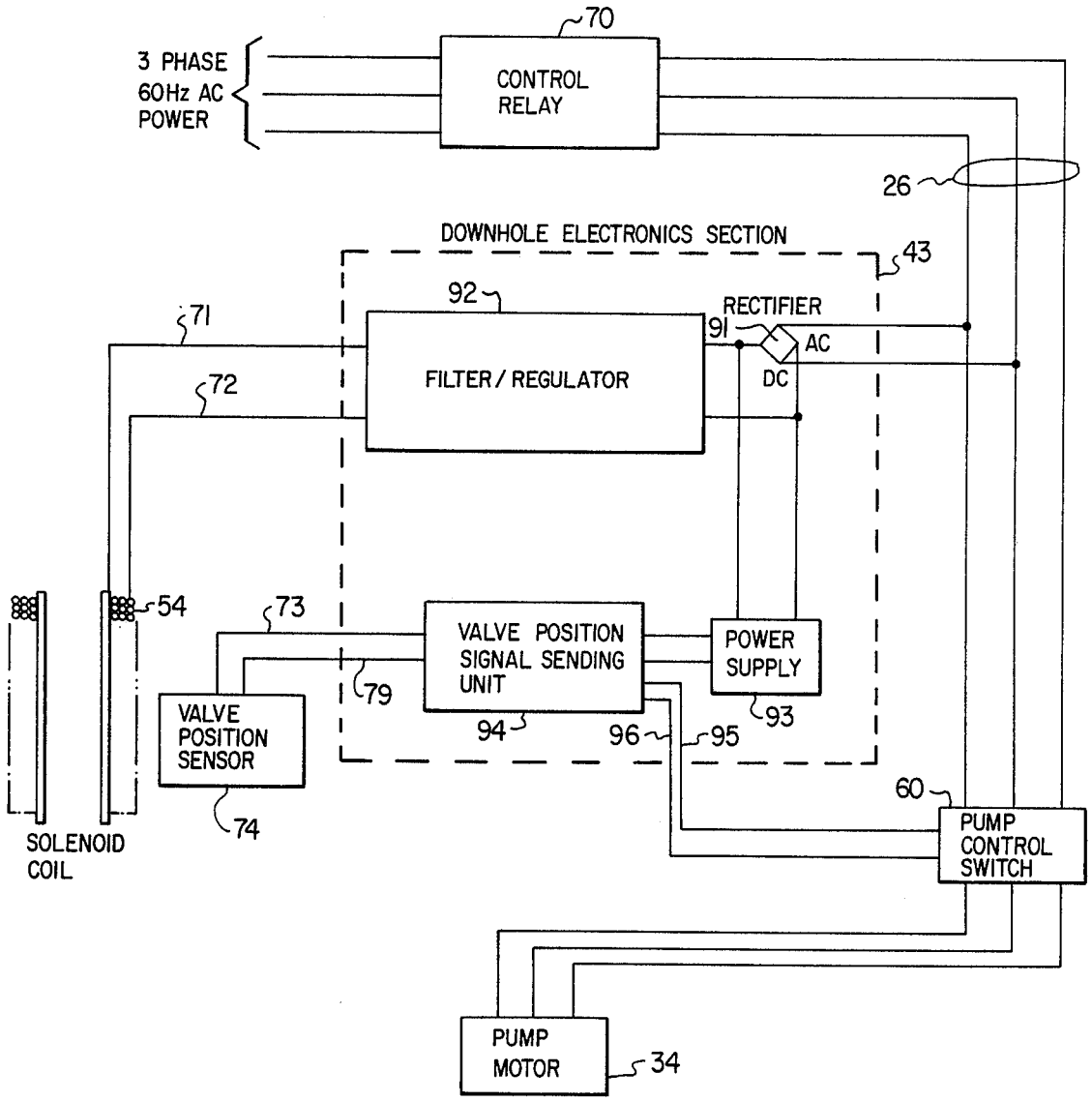
FIG. 5 is a block diagram of an alternate embodiment of the system of the invention.

Referring now to FIG. 5 there is shown a block diagram of an alternative embodiment of an electrically operated pump and safety valve system constructed in accordance with the invention. In this embodiment only one frequency of AC power is employed to both control the solenoid operated safety valve and drive the pump motor.

Three phase 60 Hz AC power is connected by a control relay 70 located at the surface. Upon actuation, the relay 70 connects three phase 60 Hz AC to the three conductors of the electrical cable 26 leading downhole. The lower end of the cable 26 is connected to the downhole electronic section 43 and to a pump control switch 60. Single phase AC power from the cable 26 is coupled to the input of bridge rectifier 91, the output DC power from which is connected to the filter/regulator 92 and the power supply 93. Filtered and regulated DC power from the unit 92 is connected via leads 71 and 72 to supply actuation current to the winding of the solenoid 54 operating the safety valve. The power supply 93 furnishes operating current for the valve position signal sending unit 94, the input of which is connected to the valve position sensor 74. The valve position sending unit output signal is connected to the pump control switch 60 which connects three phase AC current from the cable 26 to the pump motor 34.

When the control relay 70 is initially actuated, three phase 60 Hz AC power from a source is applied to the surface end of the three conductor downhole cable 26. The pump motor 34 does not start because the pump control switch 60 is unactuated to interrupt the flow of current thereto. Single phase AC power through the bridge rectifier 91 and current on leads 71 and 72 from the output of the filter/regulator 92 operate the solenoid 54 to open the safety valve. When the valve becomes fully open that condition is detected by valve position sensor 74 which produces a signal on leads 73 and 79 to the valve position signal sending unit 94. The output signal on lines 95 and 96 to the pump control switch 60 causes it to operate to close the circuit and connect the three phase AC power from the downhole cable 26 to the pump motor 34. Any movement of the position of the solenoid operated downhole safety valve from a full open condition is detected by sensor 74 causing valve position signal sending unit 94 to effect the opening of the pump control switch 60 and stop the pump motor 34. Thus, opening of the control relay 70 at the surface would interrupt current to the rectifier 91 causing deactuation of the solenoid 74 to close the safety valve and stop the pump motor 34.

The system and/or the solenoid operated safety valve may also be equipped with other emergency condition sensors such as those which detect wellhead damage, a sudden dangerous increase in production pressure or other conditions necessitating a closure of the safety valve. Such sensors could provide an output signal to operate the power interrupt relay 80 to stop pump motor 34 and close the solenoid operated safety valve 42 or could act directly to effect closure of the safety valve itself and thereby cause the control system to shut itself down as described above.

Figure 6:
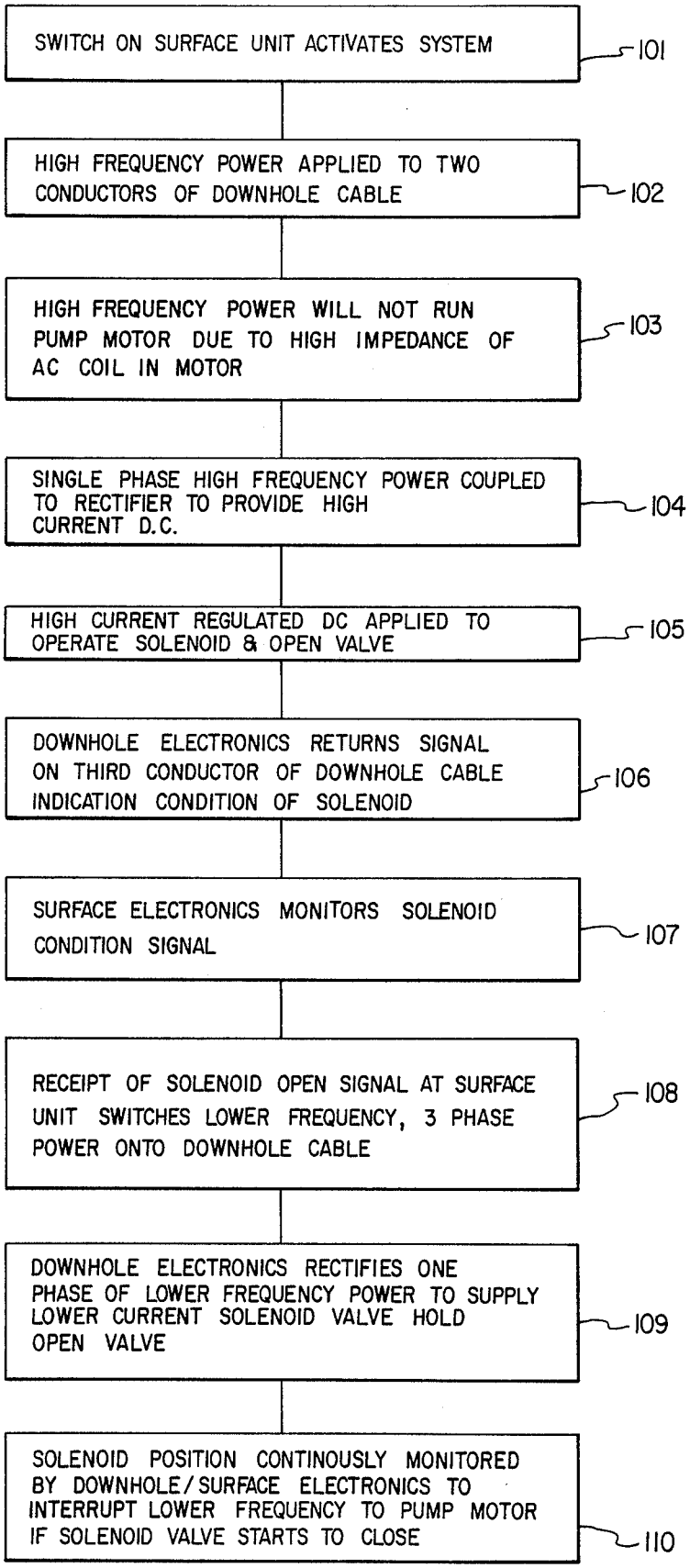
FIG. 6 is a flow chart of the sequence of operation of the system of the present invention.

Referring now to FIG. 6, there is shown a flow diagram of the operation of one aspect of the system of the present invention. The flow chart describes the operation in terms of the sequence of events following the switching on of the system. First, as shown at 101 switching on the surface unit of the system activates the rest of the system components. Next, as illustrated at 102, high frequency power is applied from the high frequency generator 86 to two lines **26*a* and 26*b* of the downhole cable 26. As illustrated at 103, the high frequency does not run the pump motor 34 due to the high impedence of the AC coil within the pump motor 34. Nevertheless, at 104 the high frequency AC power sent downhole is rectified to DC and regulated in the downhole electronic section 43 and full DC power is applied through the filter/regulator 92 to operate the solenoid coil 94 over the leads 71 and 72 as illustrated at 105**.

In the next step, at 106, the downhole electronics section 43 returns a signal from the valve position sensor 74, through the valve position signal sending unit 95, and via lines **26*a* and 26*c* of the downhole cable 26 to indicate the open state of the solenoid operated safety valve. At 107, the surface electronics 25 monitors the valve position signal on lines 26*b* and 26*c* and the valve position signal monitor 88 provides an output signal to the winding 85 of the relay 75. At 108, the relay 75 within the surface electronic unit 25 operates to switch the three phase AC power on the contacts 81, 82 and 83 to supply three phase AC power at a lower frequency, such as 60 Hz to the cable 26. The three phase power coming from the source through the interrupt relay 80 and the contacts 81, 82 and 83 is then conducted down the three conductors 26*a*, 26*b*, and 26*c* of the downhole cable 26 to power the pump motor 34. The motor 34 drives the pump sections 37 and 39 to pump hydrocarbons from within the casing back up the tubing 17** to surface.

The downhole electronic section 43 also rectifies the lower frequency single phase AC on lines **26*a*, 26*b* by means of the rectifier 91 and the filter/regulator 92 to supply a lower value hold open current on the lines 71 and 72 to the solenoid coil 54. Thus, the solenoid operated safety valve 42 is held in the open position while the pump is in operation. The holding current produced by rectifying the lower frequency AC is illustrated at 109. At 110 of the flow chart, it is illustrated that the valve position is continuously monitored by the valve position sensor 74 and the valve position signal sending unit 94 of the down hole electronics module 43. In the event that the valve starts to close for any reason, for example, interruption of the signals in the cable, interruption of a pressure sensor in the uphole device, or a rapid increase in flow rate through the valve, this change in valve condition from full open toward closed is detected uphole. The pump is then immediately shut off by the deenergization of the coil 85 of the relay 75 to move the contacts 81, 82 and 83 of the relay and disconnect three phase power from the pump motor 34 and operate the interrupt relay 80** to shut down the system.

Thus it can be seen how the system of the present invention overcomes the difficulties inherent in the prior system by providing power and control signals along a single cable which is used to supply both the operating power needs of the pump motor as well as the current necessary to actuate the solenoid at a relatively high current value for switching the solenoid and at a lower solenoid holding current value and, at the same time, continuously monitor the condition of the valve.

It is thus believed that the operation and construction of the present invention will be apparent from the foregoing description. While the method, apparatus and system shown and described has been characterized as being preferred it would be obvious that various changes and modifications may be made therein without departing from the spirit and scope of the invention as defined in the following claims.

What is claimed is:

1. A submersible pump and solenoid operated safety valve system for use in a borehole, comprising:

a submersible pump driven by an electric motor positioned down in a borehole and connected to conduit means to produce a flow of well fluids within the borehole toward the surface;

a solenoid operated safety valve connected to interrupt the flow of well fluids toward the surface in response to the interruption of current to the solenoid holding said safety valve in an open condition;

a surface control unit;

a downhole control unit positioned down in the borehole and connected to said surface control unit and to the motor of said pump by means of an electrical cable;

means for supplying AC electrical power from said surface unit down the conductors of said cable; and means mounted within said downhole control unit for providing electric current for operating said solenoid to open said safety valve.

2. A submersible pump and solenoid operated safety valve for use in a borehole as set forth in claim 1 which also includes:

means responsive to said safety valve being in an open condition for connecting AC power to the motor of said pump.

3. A submersible pump and solenoid operated safety valve for use in a borehole as set forth in claim 2 wherein:

said means mounted within said downhole control unit provides DC electric current for operating said solenoid and includes a rectifier.

4. A submersible pump and solenoid operated safety valve for use in a borehole as set forth in claim 1 wherein:

said submersible pump is connected to the end of a tubing string extending from the surface down the borehole.

5. A submersible pump and solenoid operated safety valve for use in a borehole or set forth in claim 4 wherein:

said solenoid operated safety valve is connected between the outlet of said submersible pump and the tubing string.

6. A submersible pump and solenoid operated safety valve system as set forth in claim 3, wherein:

the AC electrical power supplied to said cable by said surface control unit includes current having at least two different frequencies, the higher frequency being sufficiently high to be incapable of operating said pump motor while being capable of providing sufficient DC current after rectification to operate said solenoid to move said safety valve from a fully closed condition to a fully open condition and the lower frequency being capable of both operating said pump motor and providing sufficient DC holding current after rectification to retain said solenoid holding said safety valve in a fully open condition.

7. A submersible pump and solenoid operated safety valve as set forth in claim 6 which also includes:

a low pass filter connected between said safety valve responsive means for connecting AC power to the motor of said pump and said motor to reject current of the higher frequency to ensure that said motor is not operated thereby.

8. A submersible pump and solenoid operated safety valve system as set forth in claim 6 which also includes:

means within said downhole control unit responsive to said safety valve being in a fully open condition for sending a full open signal up said cable to said surface control unit.

9. A submersible pump and solenoid operated safety valve system as set forth in claim 8, wherein said surface control unit, includes:

switching means for selectively connecting the conductors of said cable to either said higher frequency power or said lower frequency power; and control means connected to said switching means and being responsive to initial operation of the system to select its connection of the higher frequency power to said cable and being responsive to the presence of a full open signal from said downhole control unit to select its connection of the lower frequency power to said cable.

10. A submersible pump and solenoid operated safety valve system as set forth in claim 9, wherein:

said cable comprises at least three electrical conductors with the switching means being adapted to connect the higher frequency power to a first pair of said conductors, to respond to the full open signal on a second pair of said conductors, and to connect the lower frequency power to all three of said conductors.

11. A submersible pump and solenoid operated safety valve system as set forth in claim 6 wherein:

said high frequency power is single phase and has a frequency on the order of 400 Hz and said lower frequency power is three phase and has a frequency on the order of 60 Hz.

12. A submersible pump and solenoid operated safety valve system as set forth in claim 10 wherein said safety valve condition responsive means comprises:

a valve position sensor connected to said safety valve for producing an output signal when said valve is in a full open condition;

a valve position signal sending unit having an input connected to the output of said valve position sensor and an output connected to the second pair of conductors of said cable for generating a full open signal on said conductors upon receipt of an output signal from said sensor.

13. A submersible pump and solenoid operating safety valve system as set forth in claim 12 wherein said valve position sensor includes a Hall effect device.

14. A submersible pump and solenoid operating safety valve system as set forth in claim 12 wherein the control means within said surface control unit includes:

a valve position signal monitor having an output connected to said switching means, an input connected to said second pair of conductors in said cable and being responsive to a full open signal on said conductors to cause said switch means to connect the lower frequency power to all three conductors of said cable.

15. A submersible pump and solenoid operating safety valve system as set forth in claim 14 wherein the switch means within said surface control unit includes:

a high frequency power generator having an output connected to the first pair of conductors of said cable;

means for connection of a source of low frequency AC power;

a triple-pole double throw relay having an actuation coil and three moveable contacts in electrical engagement with a first contact set when the relay is unactuated and a second contact set when the relay is actuated by current through the actuation coil, the moveable contacts being connected to said means for connection to a source of low frequency AC power; and said first contact set being connected to supply operating current to said high frequency power generator, said second contact set being connected to all three conductors of said cable, and said actuation coil being connected to the output of said valve position signal monitor to actuate said relay upon receipt of a signal therefrom.

16. A submersible pump and solenoid operating safety valve system as set forth in claim 15 wherein:

said means for connection to a source of low frequency AC power includes a three pole interrupt relay being responsive to a signal from said valve position signal monitor indicative of the absence of a valve full open signal on the second pair of conductors of said cable to interrupt the flow of lower frequency AC power to said switching means and stop the pump motor.

17. A control system for supplying power to a submersible pump and a solenoid operated safety valve in a petroleum production well completion within a borehole comprising:

means mounted within a surface control unit for selectively supplying electric power at a pair of different operating frequencies, the lower frequency power being capable of driving a motor for said pump and the higher frequency power being incapable of driving said motor for said pump;

a downhole control unit including means responsive to said higher frequency power for actuating a solenoid to open said safety valve and responsive to the open condition of said safety valve to produce a signal;

a cable interconnecting said surface control unit and said downhole control unit for conducting power at both frequencies downhole and conducting a signal uphole indicative of the open or closed condition of said safety valve; and means in said surface control unit for first connecting the higher frequency power to said cable and then, in response to a valve open condition signal, connecting the lower frequency power to said cable to drive the motor for said pump.

18. A control system as set forth in claim 17 wherein said power connecting means disconnects the higher frequency power from said cable and connecting the lower frequency power to said cable.

19. A control system as set forth in claim 17 wherein:

said downhole control unit includes a rectifier for producing DC current from said high frequency power to actuate the solenoid to move said safety valve from closed to open condition and for producing DC current from said low frequency power to actuate the solenoid to hold said safety valve in open condition.

20. A control system as set forth in claim 19 wherein said surface control unit also includes:

means responsive to an interruption of the valve open condition signal for interrupting the lower frequency power to said cable an stopping the motor driving said pump.

21. A control system as set forth in claim 17 wherein said lower frequency power is three phase with a frequency on the order of 60 Hz and the higher frequency power is single phase with a frequency on the order of 400 Hz.

22. A control system as set forth in claim 17 wherein said cable includes at least three electrical conductors, the single phase high frequency power being applied to a first pair of conductors by the surface control unit, the valve open condition signal being applied to a second pair of conductors by the downhole control unit and the three phase low frequency power being applied to all three conductors by the surface control unit.

23. A control system as set forth in claim 20 which also includes means responsive to an interruption of the valve open condition signal for interrupting all electrical power to said surface control unit.

24. In a control and power supply system for controlling the operation of a submersible pump and solenoid operated safety valve system of the type including a surface control unit for supplying AC electrical power to a cable extending downhole to the motor driving said pump and to said solenoid operating said safety valve, the combination comprising:

a downhole control unit for connection of the cable from the surface unit including means for producing current to actuate the solenoid and control the opening of the safety valve means and for connecting AC current to the motor to drive the pump when the safety valve is open.

25. The combination as set forth in claim 24 wherein said downhole control unit also includes:

means responsive to the safety valve being open for generating a signal indicative thereof to be communicated to the surface control unit by means of the cable.

26. The combination as set forth in claim 24 wherein the solenoid current producing means included in said downhole control unit comprises a rectifier which is responsive to AC electrical power having a frequency greater than that which will operate the pump motor to produce DC current to initially operate the solenoid to open the safety valve before the pump motor is turned on as well as responsive to a lower frequency which operates the pump motor to hold the solenoid actuated and the safety valve in an open condition while the pump is operating.

27. A method for supplying power to a submersible pump and a solenoid operated safety valve in a petroleum production well completion within a borehole, comprising:

selectively supplying electric power with a surface control unit at a pair of different operating frequencies, the lower frequency power being capable of driving a motor for said pump and the higher frequency power being incapable of driving said motor for said pump;

actuating a solenoid in response to said higher frequency power with a downhole control unit to open said safety valve;

producing a signal in response to the open condition of said safety valve with a downhole control unit;

providing a cable interconnecting said surface control unit and said downhole control unit for conducting power at both frequencies downhole and conducting a signal uphole indicative of the open or closed condition of said safety valve; and first connecting the higher frequency power to said cable with the surface control unit and then, in response to a valve open condition signal from the downhole control unit, connecting the lower frequency power to said cable with the surface control unit to drive the motor for said pump.

28. A method as set forth in claim 27 which also includes:

disconnecting the higher frequency power from said cable simultaneously with connecting the lower frequency power to said cable.

29. A method as set forth in claim 27 which also includes:

producing DC current downhole from said high frequency power to actuate the solenoid to move said safety valve from closed to open condition and for producing DC current downhole from said low frequency power to actuate the solenoid to hold said safety valve in open condition.

30. A method as set forth in claim 28 which also includes:

interrupting the lower frequency power to said cable and stopping the motor driving said pump in response to an interruption of the valve open condition signal.

31. A method as set forth in claim 27 wherein said lower frequency power provided is three phase with a frequency on the order of 60 Hz and the higher frequency power provided is single phase with a frequency on the order of 400 Hz.

32. A method as set forth in claim 27 wherein said cable provided includes at least three electrical conductors, the single phase high frequency power being applied to a first pair of conductors by the surface control unit, the valve open condition signal being applied to a second pair of conductors by the downhole control unit and the three phase low frequency power being applied to all three conductors by the surface control unit.

33. A method as set forth in claim 30 which also includes:

interrupting all electrical power to said surface control unit in response to the interruption of the valve open condition signal.

* * * * *